US008132585B2

(12) United States Patent
Rothweil

(10) Patent No.: US 8,132,585 B2
(45) Date of Patent: Mar. 13, 2012

(54) COLLAPSIBLE FOOD PROTECTIVE ENCLOSURE

(75) Inventor: Daniel A. Rothweil, Poway, CA (US)

(73) Assignee: D-Squared Product Development, Poway, CA (US)

( * ) Notice: Subject to any disclaimer, the term of this patent is extended or adjusted under 35 U.S.C. 154(b) by 773 days.

(21) Appl. No.: 12/190,747

(22) Filed: Aug. 13, 2008

(65) Prior Publication Data

US 2009/0084798 A1 Apr. 2, 2009

Related U.S. Application Data

(60) Provisional application No. 60/967,070, filed on Aug. 31, 2007.

(51) Int. Cl.
*E04H 15/58* (2006.01)

(52) U.S. Cl. ..... 135/124; 135/117

(58) Field of Classification Search ..... 135/115, 135/117, 119, 124, 125, 156, 906; 160/349.1
See application file for complete search history.

(56) References Cited

U.S. PATENT DOCUMENTS 3,943,953 A * 3/1976 Cantwell et al. ..... 135/156
4,550,760 A * 11/1985 Gidge et al. ..... 160/328
4,858,635 A * 8/1989 Eppenbach ..... 135/125
5,078,096 A * 1/1992 Bishop et al. ..... 119/497
5,273,142 A * 12/1993 Weber ..... 190/107
5,311,813 A * 5/1994 Fairbanks et al. ..... 99/645
5,676,168 A * 10/1997 Price ..... 135/126
5,832,943 A * 11/1998 Johnson ..... 135/124
6,371,143 B1 * 4/2002 Swetish ..... 135/125
6,715,446 B2 * 4/2004 Chou ..... 119/497
7,131,481 B2 * 11/2006 Varley et al. ..... 160/273.1
7,201,177 B2 * 4/2007 Anticoli et al. ..... 135/125
7,322,315 B2 * 1/2008 Brewer et al. ..... 119/498
7,607,445 B2 * 10/2009 von Dewitz et al. ..... 135/114
2003/0024560 A1 * 2/2003 Tomason ..... 135/90
2004/0050410 A1 * 3/2004 DeLong ..... 135/88.13
2008/0047597 A1 * 2/2008 Rothweil ..... 135/126
2009/0283120 A1 * 11/2009 Varga et al. ..... 135/16

* cited by examiner

*Primary Examiner* — Noah Chandler Hawk
(74) *Attorney, Agent, or Firm* — The Nath Law Group

(57) ABSTRACT

A collapsible enclosure for protecting food from pests and debris comprises in one configuration at least two flexible structural beams, a cover having a top portion and a bottom portion, at least one opening and at least one flap attached above the opening. The flap is substantially larger in length and width than the opening and has ballast along its base to hold it flush against the at least one opening. In another configuration the collapsible protective food enclosure comprises three or more resilient structural frame loops, a cover having at least one opening and a flap. The structural frame loops are affixed within the cover forming walls. The flap is attached above the opening and has a resilient structural frame loop affixed along its perimeter to allow the flap to fit flush against the at least one opening.

6 Claims, 2 Drawing Sheets

COLLAPSIBLE FOOD PROTECTIVE ENCLOSURE

CROSS-REFERENCE TO RELATED APPLICATIONS

The present application claims priority to U.S. provisional patent application Ser. No. 60/967,070 filed Aug. 31, 2007, entitled "A Collapsible Food Protective Enclosure," which is incorporated by reference into the instant application as if set forth verbatim.

FIELD OF THE INVENTION

This invention relates to devices used in protecting food placed on a table. More particularly, to prevent insects and other contaminants from accessing or entering the food while present on a table and prior to being consumed.

BACKGROUND OF THE INVENTION

A number of devices are available commercially for protecting food placed on a table either inside or out during events such as parties, picnics, fairs, carnivals, etc. The most common is called the food tent (available though www.improvementscatalog.com and www.cooking.com) and is a netted dome having a handle positioned at the top and about the center of the dome for easy access to the food protected within. Unfortunately, because these devices do not have a base, insects can easily access the food by crawling under the edge of the dome or through the openings between the wooden slats of the picnic table. In addition, these dome structures can be easily lifted and blown off the table in a strong breeze.

Consequently, there is a need for a protective food cover that does not provide easy access to insects or debris and that is not easily dislodged from its resting-place due to wind.

SUMMARY OF THE INVENTION

The present invention is a collapsible enclosure for protecting food from pests and debris. In one embodiment it includes at least one flexible structural beam and a cover having a base and a sidewall with at least one opening. The cover has at least one beam retainer for receiving the at least one flexible structural beam and at least two beam pockets for receiving and anchoring opposite ends of the flexible structural beam. When the at least one beam is received in the beam pockets and the beam retainer, the beam becomes bent and thereby supports the cover in an upright position. The outer surface of the cover has a flexible flap directly above the opening, and a flap retainer directly above the flap to optionally hold the flap away from the opening. The flap is substantially larger in its length and width than the opening and has a free-hanging bottom edge with ballast along its base to hold the flap flush against the opening. The collapsible enclosure may also include one or more straps for securing the device to a surface such as a table.

The ballast in the flap may be an elongate rod inserted into a sleeve along the free-hanging bottom edge of the flap. Alternatively, the ballast may be granular material such as sand or metal pellets stuffed inside the sleeve of the flap. The beam retainer on the cover may be on either the inner our outer surface of the cover, and may be a sleeve or rings for receiving the flexible structural beam. The beam retainer may also be one or more hooks which hold the cover against the flexible structural beam.

In another embodiment, the collapsible protective food enclosure has a cover with at least a base and first and second side walls. The first side wall has an opening and a flexible flap is hinged to the outer surface of the cover directly above the opening. The base, the first and second side walls, and the flexible flap each have a sleeve around their perimeters. Received in each sleeve is a resilient structural frame loop. The loops can be compressed to collapse the enclosure, but when they are released their resilient nature causes the enclosure to expand into an upright position. The flap, which is longer and wider than the opening, normally rests against the first side wall to close the opening, but may also be retained in an open position using flap securing elements attached to the rim of the flap.

BRIEF DESCRIPTION OF THE DRAWINGS

These and other features of the invention are described in further detail in the following description and will be better understood with reference to the accompanying drawings, which are briefly described below.

DETAILED DESCRIPTION

Figure 1B:
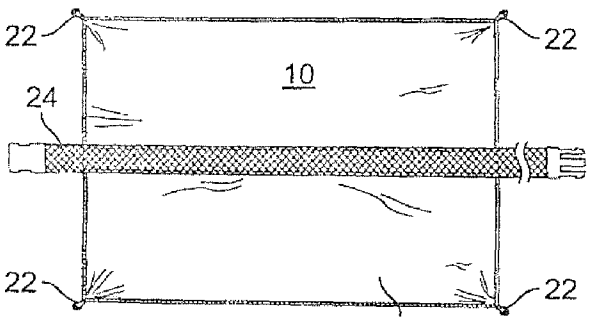
FIG. 1B shows a bottom view of the enclosure of FIG. 1A.
Figure 1A:
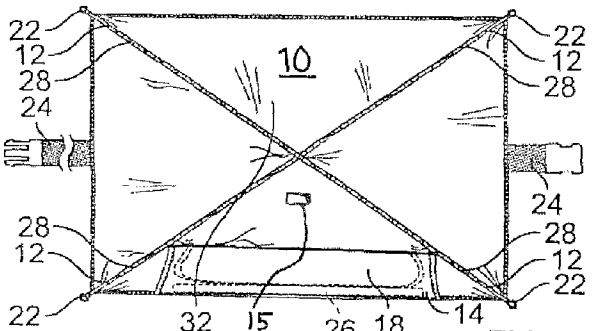
FIG. 1A shows a top view of a collapsible food protective enclosure having a flexible structural beam configuration.
Figure 1E:
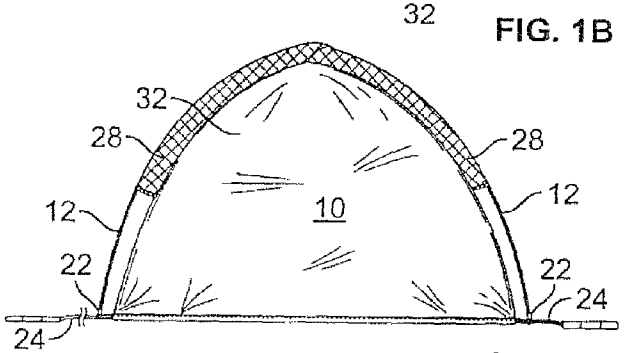
FIG. 1E shows a back view of the enclosure of FIG. 1A.
Figure 1C:
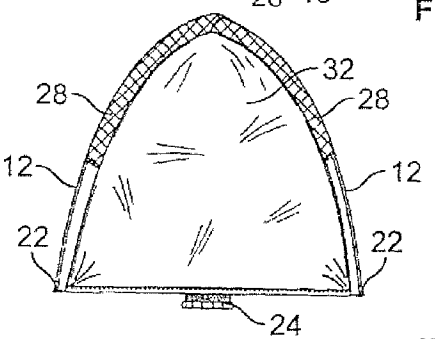
FIG. 1C shows a side view of the enclosure of FIG. 1A.
Figure 1D:
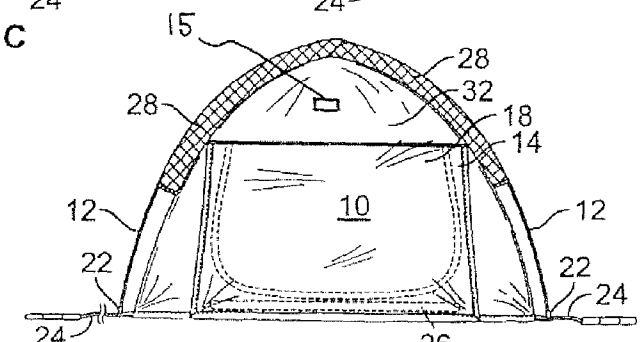
FIG. 1D shows a front view of the enclosure of FIG. 1A.
Figure 2A:
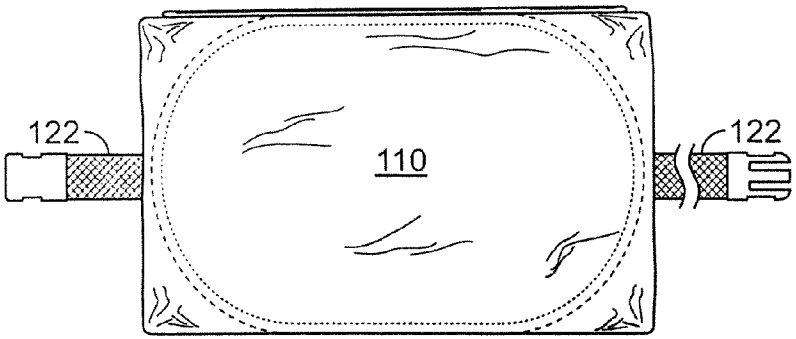
FIG. 2A shows a top view of a collapsible food protective enclosure having a flexible loop configuration.
Figure 2B:
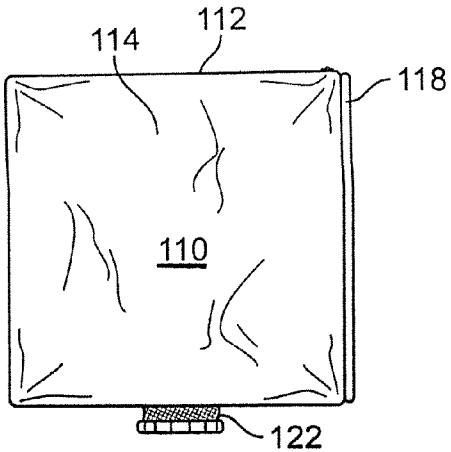
FIG. 2B shows a side view of the enclosure of FIG. 2A.
Figure 2C:
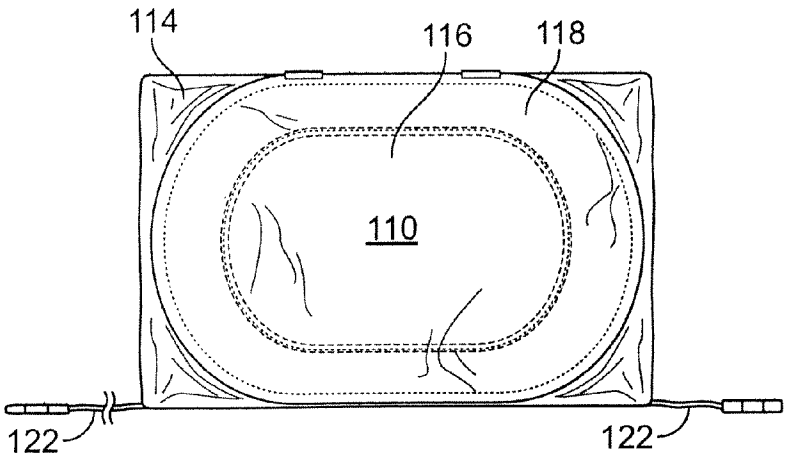
FIG. 2C shows a front view of the enclosure of FIG. 2A.
Figure 2D:
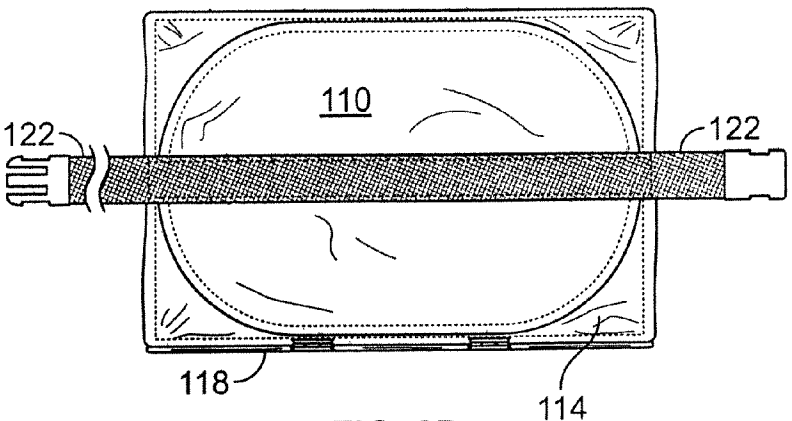
FIG. 2D shows a bottom view of the enclosure of FIG. 2A.

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "beam retainer" as used herein refers to a structure for securely, yet reversibly attaching flexible structural beams to the cover by a variety of methods including for example providing an insert sleeve, hooks, ties, pockets and the like.

The term "affixed" as used herein refers to a secure attachment of one element of the invention to another such as by stitching, sewing or adhesive. Stitching refers to securely attaching an element by thread while sewing refers to securely attaching an element by looping fabric about an element and sewing the loop or sleeve closed.

Exemplary embodiments of the invention will now be described in detail below with reference to the appended figures, wherein like elements are referenced with like numerals throughout. The figures are not necessarily drawn to scale and do not necessarily show every detail or structure of the various embodiments of the invention, but rather illustrate exemplary embodiments and mechanical features in order to provide an enabling description of such embodiments.

In one preferred configuration the collapsible enclosure of the present invention comprises at least two flexible structural beams and a cover having a top portion and a bottom portion, the top portion having affixing means for receiving the at least two flexible structural beams, at least one opening and at least one flap attached above the opening, the flap being substantially larger in length and width than the opening and having ballast along its base to hold the flap flush with the at least one opening.

Flexible Structural Beams

In this configuration the flexible structural beams 12 of the present invention are sufficiently flexible to allow them to bend into the form of the cover and maintain the cover 32 in an open and upright position. Because of this the flexible structural beams 12 may be made of a variety of materials and in a variety of configurations that provide this flexibility. For example, the flexible structural beams 12 may be made of fiberglass, carbon fiber, plastic or wood. Possible configurations include round cylindrical, hollow round cylindrical or elongated beam having a vertical cross section in the shape of an "X" or a "+". The flexible structural beams 12 are provided in a length to traverse the cover from one corner to the opposite corner.

The two or more flexible structural beams 12 may be independent of each other or they may be joined together at the midpoint along their length. The joined configuration assists in ease of assembly and for compact storage.

The flexible structural beams 12 are attached to the cover by beam retainers 28. In the case where the flexible structural beams 12 are independent of one another the affixing means 28 may be two or more sleeves along the length of the top portion of the cover 32 from one corner to the opposite corner. Preferably there are two lengths of sleeves 28 one along the upper portion of the top portion and the other along the lower portion of the top portion. At the center, or apex, of the top portion may be a tie for securing the top of the cover 32 to the apex of the arched flexible structural beams 12. Correspondingly, the ends of the flexible structural beams 12 may be fit into beam pockets 22 at the corners of the cover 32. Hooks connected at or about regular intervals along the top portion of the cover 32 in line with the placement of the flexible structural beams 12 are then clasped around the flexible structural beams 12 securing the cover 32 in an open and upright position. Like in the example above the center, or apex, of the top portion may have a tie for securing the top of the cover 32 to the apex of the arched flexible structural beams 12. In this same fashion flexible structural beams 12 that are connected at their midpoints along their length may be affixed to the cover 32.

In another configuration the flexible structural beams 12 are positioned in place within the enclosure. Preferably the flexible structural beams 12 are connected to one another at their midpoint along their length. The supports are inserted into the enclosure through the opening 18 and the ends inserted into beam pockets 22 positioned in the corners of the interior of the cover 32. The apex of the top of the cover 32 may have a means for securing the flexible structural beams 12 such as a tie. Alternatively, flexible structural beams 12 may have a small magnetically susceptible metal disc or snap affixed at the apex. In this case, the apex of the cover 32 could have a magnet or snap respectively to connect to the top of the flexible structural beams 12.

Depending on the actual size of the cover 32 the flexible structural beams 12 may be provided in a single continuous length, a series of connectable sections of a particular length or have hinges which allow them to be folded in the collapsed configuration. In a connectable section configuration each section has a female connector on one end and a male connector on the other to allow the sections to be joined forming a complete structural support 12. These sections may be independent of each other or they may be connected by an elastic cord running through their lengths to prevent one or more of the lengths from being misplaced. In the hinged configuration the flexible structural beams 12 are provided in two or more sections joined by a hinge that allows the structural support 12 to pivot in a plane approximately 180°. The length of the connectable sections or the hinged sections may be determined by the desired size of the container that will hold the device 10 in its collapsed form.

Flexible Cover

The cover 32 of the present invention preferably has a weave or mesh that allows the user to see and/or identify the food items stored in the enclosure 10, has a weave or mesh size that prevents insects and most debris from entering the enclosure 10, is made of a material that is resilient to being stretched and similar in flexibility to cloth. A number of netting materials that have these characteristics are commercially available and are often used for preparing tents and other large enclosures.

The cover 32 may have one or more openings 18 that allow the user to enter and exit the enclosure 10 to access the food within. The size of the openings 18 will depend on the items to be housed within the enclosure 10 and the types of access desired. These are balanced with the desire to secure the contents from access by unwanted insects and debris. In particular, the diameter of the plates and dishes the user intends to place in the enclosure 10 will determine the width of the opening or openings 18. For example, if the diameter of a plate to be stored in the enclosure 10 is 9" then the width of the opening 18 should be larger than 9". Correspondingly, if the height of a bowl to be placed in the enclosure 10 is 7" then the height of the opening 18 should be at least 7".

For multiple access there may be more than one opening 18 and they may be positioned on different sides of the enclosure 10. Clearly increasing the number of openings 18 and the amount of time for which the flaps 14 are opened during access will increase the opportunity for unwanted entry by insects and debris. Consequently, it is preferable to limit the number of openings 18 in the cover 32.

The cover 32 may further comprise a flap retainer 15 positioned above and about the center of the opening 18 to prevent the flap 14 from contacting the food when accessing the interior of the enclosure 10. A variety of flap retainers 15 for securing the flap 14 to the enclosure 10 may be utilized with the present invention including for example a latch, Velcro™, magnet, or tie. The type and position of the flap retainers 15 will depend on the length of the flap 14. Generally the flap 14 is rolled or bunched and secured at the top of the opening for ease of access to the inside of the enclosure 10. If the flap 14 is 9" in height, it may not be feasible to place the flap retainers 15 7" or more above where the flap 14 is connected to the cover 32 because there would not be sufficient material in the flap 14 at that distance to effectively secure it in the open position. Preferably a hook and loop fastener is used as the flap retainer 15. In this configuration, the hook material could be affixed at about 1-2" above the center of the opening and the loop portion could be placed on the inside surface of the flap 14 about 2-3" inches from the top and about the center of the flap 14. When entry is desired the user can roll the flap 14 onto the ballast bar 26 and secure the flap 14 by pressing the hook and loop portions together.

Adjustable Securing Strap

One or more adjustable securing straps 24 may be provided and affixed to the base of the cover 32 so that the enclosure 10 may be secured to a surface. The securing straps 24 may be made of a wide variety of materials that provide sufficient strength and durability to maintain the enclosure 10 on the intended surface. Nylon strapping similar to that used in camping equipment would be preferable. These securing straps 24 may be fastened by tying, by snap connectors similar to those used on backpacks or by loop through strap connectors similar to those used on luggage.

Flap and Ballast

The dimensions of the flexible flap 14 exceed both the length and width of the opening 18 to prevent undesired entry by insects or debris. The base of the flap 14 has a free-hanging bottom edge with a sleeve which is provided with ballast 26 to assure that the bottom edge of the flap 14 rests against the outside of the side wall of the cover 32 and that the overlap of the flap 14 remains flush along the sides of the opening 18. The flaps 14 are preferably made of the same or similar material as the cover 32. The ballast 26 may be made of any elongated material that is the same or longer than the width of the flap 14 and provides sufficient weight to keep the flap 14 flush along the side of the opening 18. For example, the ballast 26 may be prepared from rod stock made of metal, heavy wood, heavy polymer or a tubular stock filled with sand or metal pellets and the like.

Preparation

The cover material is cut from a desired material stock and preferably sewn together in a way that resists tearing from stretching and prevents the formation of holes that could be accessible by insects. The flexible structural beams are preferably made of a continuous length of flexible polymer. The ballasts are preferably cut from solid cylindrical stock material of the desired diameter and of sufficient weight to exert the desired downward force on the flaps. The flaps are prepared separately having a sleeve on one end to receive the ballast. The top of the flaps are preferable sewn above the openings so that there is a substantial overlap on all sides of the opening with the ballast sleeve positioned at the base of the opening.

Use

The cover and flexible structural beams are removed from the protective transport cover. The cover is spread on a flat surface having its bottom portion flush with the flat surface. Each flexible structural beam is threaded through one set of beam retainers extending from one corner of the cover to the opposite corner with the beams crossing over at the top of the cover. The ends of the beams are anchored in beam pockets at the corners of the cover. The two beams are secured by the use of a tie at the top of the cover. Preferably the ballasts are permanently secured within the sleeves of the flaps. Alternatively, they may be inserted into the sleeves provided at the base of the flaps when in use. Adjustable securing or tie down straps affixed to the base of the cover are used to encircle the surface or portion of the surface on which the enclosure has been placed and secure it to the surface or table top. When entering the enclosure the flap is lifted or rolled and secured above the opening. Food may be inserted into the enclosure through the opening. When the food is in position the flap is released and allowed to lay flush and cover the opening preventing unwanted insects or debris from entering the food. The enclosure may be broken down and stored by reversing this procedure.

In another preferred configuration of the present invention the collapsible protective food enclosure comprises three or more resilient structural frame loops, a cover having at least one opening and a flap. The structural frame loops are affixed within the cover to form the walls. The flap is attached above the opening and has a resilient structural frame loop affixed along its perimeter to allow the flap to fit flush against the opening.

Structural Frame loops

In this configuration the structural frame loops 112 of the present invention are sufficiently flexible to allow them to bend into the form of the cover 114 and maintain the cover 114 in an open and upright position. In addition the structural frame loops 112 can be twisted and folded over in an overlapping circular configuration that allows for easy compact storage.

A variety of materials may provide these desired characteristics such as for example steel wire or polymer. The frame 112 is generally constructed from linear pieces of material that are joined into loops by fusing the ends such as by welding or adhesive. The structural frame loops 112 may then be affixed to the cover 114 by a variety of methods including stitching the frame loops 112 within the interior of the cover 114 such that they form the sides of the enclosure 110. Alternatively, the structural frame loops 112 can be sewn into the perimeter edges of the material pieces used to construct the enclosure 110 by wrapping and securing the material over the frame 112 by sewing. For example, structural frame loops 112 can be sewn into the material pieces used to construct the walls, top and bottom of the enclosure 110. These can then be joined forming a tubular structure. End pieces are then sewn onto this tubular structure to complete the enclosure 110. In this type of configuration as little as three structural frame loops 112 may be used to construct the enclosure 110, two for the sides and one for the base with the two ends held taught by the three frame loops 112. No structural frame loops 112 are required for the ends of the enclosure 110.

Flexible Cover

The flexible cover 114 of the present invention preferably has a weave or mesh that allows the user to see and/or identify the food items stored in the enclosure 110, has a weave or mesh size that prevents insects and most debris from entering the enclosure 110, is made of a material that is resilient to being stretched and similar in flexibility to cloth. A number of netting materials that have these characteristics are commercially available and are often used for preparing tents and other large enclosures.

The cover 114 will have one or more openings 116 that allow the user to enter and exit the enclosure 110 to access the food or items within. The size of the openings 116 will depend on the items to be housed within the enclosure 110 and the types of access desired. These are balanced with the desire to secure the contents from access by unwanted insects and debris. Particular examples of how to determine the size of a desired opening 116 are provided above.

For multiple access, there may be more than one opening 116 and they may be positioned on different sides of the enclosure 110. Increasing the number of openings 116 and the amount of time for which the flaps 118 are opened during access will increase the opportunity for unwanted entry by insects and debris. Consequently, it is preferable to limit the number of openings 116 in the cover 114.

The cover 114 may further comprise a means for securing the flap 118 positioned above and about the center of the opening 116 to prevent the flap 118 from contacting the food when accessing the interior of the enclosure 110. A variety of means for securing the flap 118 to the exterior enclosure 110 may be utilized with the present invention including for example a latch, Velcro™, magnet, or tie. Preferably the flap 118 is pivotally affixed to the structural loop frame 112 above the opening 116 so that it may be rotated from the opening 116 and allowed to rest on the adjacent side or top. The flap 118 may be secured in both the closed and open position. In the closed position, the securing elements may be provided along the entire perimeter of the flap 118 or only on a small portion of the flap 118. Correspondingly, securing elements are also provided about the opening 116 for making contact with the securing elements of the flap 118 securing the flap in the closed position. In the open position the flap 118 may be actively secured to an adjacent side or top by a securing element or may simply rest on the adjacent side or top.

Adjustable Securing Straps

Securing straps may be provided and affixed to the base of the cover 114 so that the enclosure may be secured to a surface. The securing straps 122 may be made of a wide variety of materials that provide sufficient strength and durability to maintain the enclosure 110 on the intended surface. Nylon strapping similar to that used in camping equipment is preferable. These securing straps 122 may be fastened by a variety of methods including tying, snap connectors similar to those used on backpacks or loop through strap connectors similar to those used on luggage. In one preferred configuration the straps 122 and snaps are provided to allow multiple enclosures to be affixed together at their base and fastened securely to a surface. For example, when the enclosure 110 is square or rectangular, female snap clip connectors may be provided on two adjacent sides of the base while male snap clip connectors are positioned on the opposite remaining two sides. This allows multiple enclosures 110 to be joined end to end and side to side. The straps 122 are preferably adjustable to assure that the enclosures can be fastened securely to a variety of surfaces having different dimensions. Alternatively, the snap clip connectors provided on the base of the enclosure 110 may have limited length, sufficient to secure one enclosure to the other. A secondary adjustable strap may then be provided able to be connected to the snap clip connectors on the ends of the multiple enclosure structure thereby securing them to a surface.

Flexible Flap

The flexible flap 118 of the present invention will have dimensions that exceed both the length and width of the opening 116 in the cover 114 to prevent undesired entry by insects or debris. The flap is preferably made of the same or similar material as the cover 114. A flexible resilient structural frame loop 112 is affixed along the perimeter of the flap 118. The flap 118 is preferably rotatably hinged onto the structural frame loop 112 above the opening 116 so that it may be rotated upward and onto an adjacent side or top. The flap 118 may also be provided with securing elements along its perimeter edge to actively secure the flap 118 in position. Alternatively, the flap 118 may merely hang over the opening 116 in the closed position or rest on an adjacent side or top in the open position.

Preparation

The cover material is cut from a desired material stock; the structural frame loops are then sewn into the appropriate pieces and then assembled into an enclosure. The seams are sewn together in a way that resists tearing from stretching and prevents the formation of holes that could be accessible by insects. Securing straps are affixed on the exterior of the base so that the connectors are positioned about the middle of each side and in such a configuration that allows one enclosure to be connected to another enclosure side by side or end to end. The flap is rotatably affixed to the structural loop frame above the opening so that there is a substantial overlap on all sides of the opening.

Use

The enclosure is packaged in the compact circular configuration. When it is removed from its case, lightly shaken or agitated and placed on a surface the resilient structural frame loops expand automatically forming the enclosure. Securing straps present on the base are used to encircle the surface or portion of the surface on which the enclosure has been placed and secure it to the surface or table top. When entering the enclosure the flap is lifted and rotated onto the adjacent side or top above the opening. Food may then be inserted into the enclosure through the opening. When the food is in position the flap rotated over the opening preventing unwanted insects or debris from entering the food.

The enclosure may be collapsed by removing the food, placing the flap in the closed position, pressing the front side onto the base which will force the top side onto the other side and folding these onto each other so that all of the sides are positioned on top of each other. Two opposite sides are grasped and twisted 180 degrees to form a figure eight. The lobes of the figure eight are folded over onto each other forming a smaller generally round compact and relatively flat package that may be easily inserted into its case for storage.

Various modifications and alterations of the invention will become apparent to those skilled in the art without departing from the spirit and scope of the invention, which is defined by the accompanying claims. Any element in a claim that does not explicitly state "means for" performing a specified function or "step for" performing a specified function is not to be interpreted as a "means" or "step" clause as specified in 35 U.S.C. §112, ¶6.

What is claimed is:

1. A collapsible food protective enclosure, comprising:

a flexible cover with an outer surface, the cover comprising a base, a beam retainer, at least first and second beam pockets, and at least one side wall with an opening devoid of sidewall material;

a flexible flap as an exclusive way to cover the opening attached to the outer surface of the cover directly above the opening in the at least one side wall, the flap having a free-hanging bottom edge with a ballast sleeve containing a ballast, wherein when the flap is in an open position, an interior of the enclosure is open to the outside;

a flap retainer affixed to the outer surface of the cover directly above the flap;

an adjustable securing strap affixed to the outer surface of the base of the cover; and a flexible structural beam retained in the beam retainer with a first end anchored in the first beam pocket and a second end anchored in the second beam pocket, the flexible structural beam holding the cover in an upright position;

wherein the flap is longer and wider than the opening and the ballast forces the free-hanging bottom edge of the flap to rest against the at least one side wall to close the opening when the flap is not retained by the flap retainer.

2. The collapsible food protective enclosure of claim 1, wherein the ballast is an elongate rod inserted inside the ballast sleeve.

3. The collapsible food protective enclosure of claim 1, wherein the ballast is granular material stuffed inside the ballast sleeve.

4. The collapsible food protective enclosure of claim 3, wherein the granular material is sand.

5. The collapsible food protective enclosure of claim 3, wherein the granular material is metal pellets.

6. The collapsible food protective enclosure of claim 1, wherein the beam retainer is a sleeve sewn into the cover.

* * * * *